United States Patent [19]

McKay et al.

[11] Patent Number: 4,670,991

[45] Date of Patent: Jun. 9, 1987

[54] DRAWING MACHINE

[75] Inventors: Robert S. McKay, 7420 Beckwith Rd., Morton Grove, Ill. 60053; Thomas A. Robbins, St. Charles; William D. Nelson, Chicago, both of Ill.

[73] Assignee: Robert S. McKay, Wood Dale, Ill.

[21] Appl. No.: 699,593

[22] Filed: Feb. 8, 1985

[51] Int. Cl.[4] ..... B43I 13/20

[52] U.S. Cl. ..... 33/565; 33/449

[58] Field of Search ..... 33/448, 449, 174 B, 33/565, 562, 564, 454

[56] References Cited

U.S. PATENT DOCUMENTS

| | | | |
|---|---|---|---|
| 1,482,930 | 2/1924 | Johnson | 33/449 |
| 1,821,369 | 9/1931 | Wetterstrand | 33/564 |
| 1,973,364 | 9/1934 | Wood | 33/564 |
| 2,543,714 | 2/1951 | Bednarczuk | 33/564 |
| 3,225,445 | 12/1965 | Duggan | 33/449 |
| 3,473,228 | 10/1969 | Hortmann et al. | 33/449 |
| 3,633,286 | 1/1972 | Maurer . | |
| 3,860,050 | 1/1975 | Banks . | |
| 3,900,956 | 8/1975 | Furuoka et al. | 33/565 |
| 4,353,672 | 10/1982 | Smith | 33/562 |

FOREIGN PATENT DOCUMENTS

| | | | |
|---|---|---|---|
| 971072 | 6/1950 | France | 33/449 |

*Primary Examiner*—Harry N. Haroian
*Attorney, Agent, or Firm*—Robert V. Jambor

[57] ABSTRACT

A drawing machine having a frame for translatory movement upon a drawing surface. The frame defines an elongated, transverse interior opening. A plurality of template means are removably receivable within the interior opening. Each includes an aperture defining a shape which may be traced upon the drawing surface by the user. The template means may be repositioned along the transverse length of the elongated interior opening. Translatory movement of the drawing machine upon the drawing surface and guided movement of the template means along the interior opening permit the user to create varied patterns and pictures.

2 Claims, 4 Drawing Figures

Fig. 1.
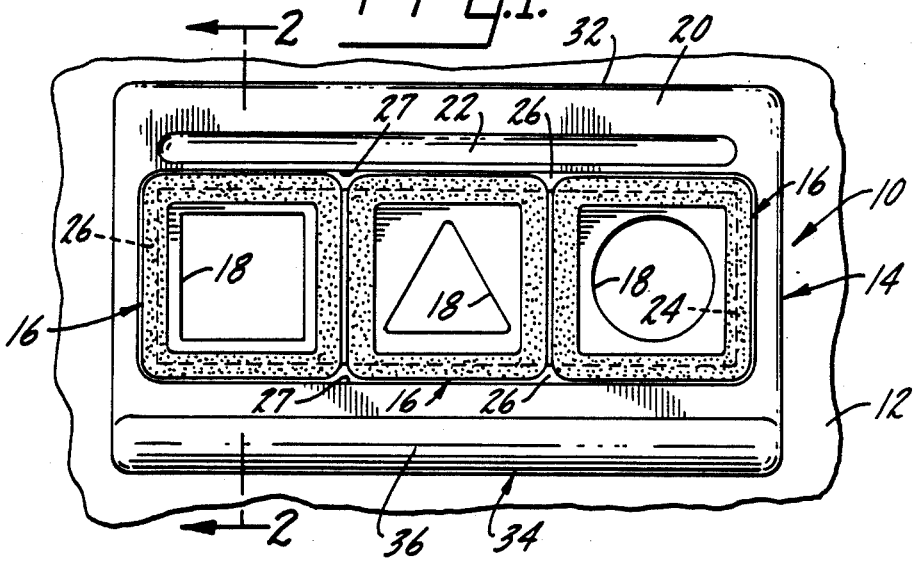
Fig. 2.
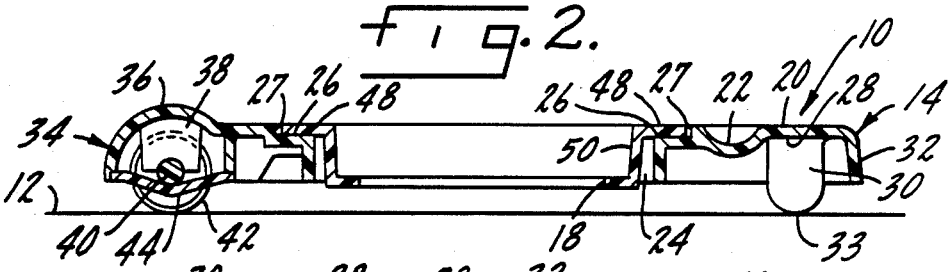
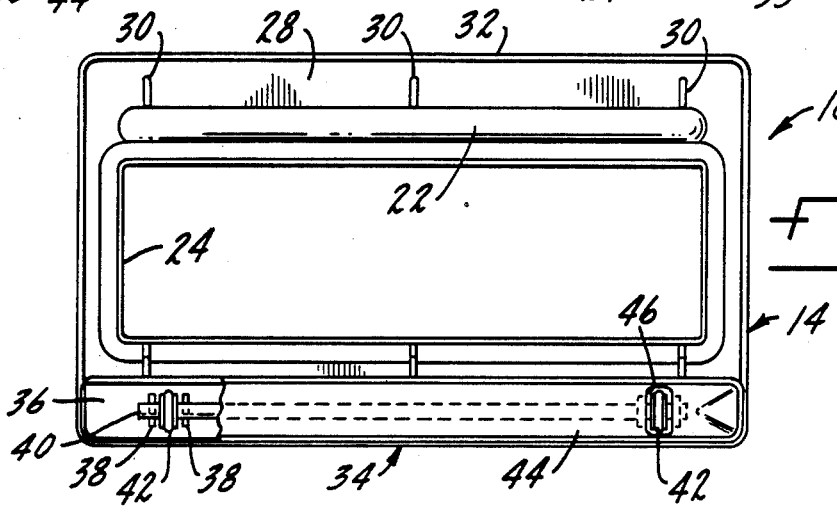
Fig. 3.
Fig. 4.
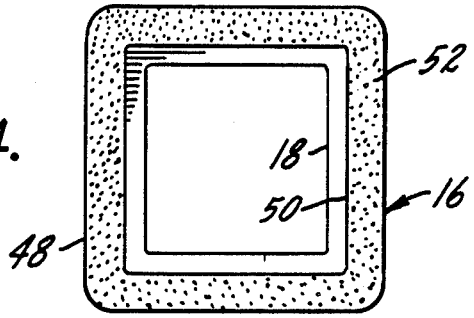

DRAWING MACHINE

BACKGROUND OF THE INVENTION

This invention relates to a drawing aid primarily for use by children. More particularly, the device of the present invention provides means for assisting the user to create shapes in varying patterns and pictures upon the drawing surface.

Drawing aids are known and include such items as triangles, protractors, compasses and the like. It has also been known to create miniaturized or downscaled toy versions of common drafting equipment such as T-squares, drafting boards and drafting machines. The present invention provides an added versatility in that it includes template means to aid in replicating shapes upon a drawing surface, and in addition, provides for guided translatory positioning of the template means to assist in pattern and picture creating activity.

The present invention includes a frame for translatory movement upon a drawing surface. The frame defines an elongated transverse interior opening which removably receives a plurality of template means. The template means each define an aperture which may be traced upon the drawing surface by the user. The template means are adapted to be guided along the transverse interior opening, which, along with translatory movement of the frame, permits for creative repetitions and variations of the traced shapes.

DESCRIPTION OF THE DRAWINGS

FIG. 1 is a top view of a toy drawing machine embodying the principles of the present invention.

FIG. 2 is a sectional view on an enlarged scale of the apparatus of FIG. 1 taken along the line of 2—2 of FIG. 1.

FIG. 3 is a bottom view of the apparatus of FIG. 1.

FIG. 4 is a top view on a slightly enlarged scale of a portion of the apparatus of FIG. 1.

DETAILED DESCRIPTION OF ILLUSTRATED EMBODIMENT

In the accompanying drawing there is illustrated a drawing machine which embodies the principles of the present invention. Essentially intended as a child's toy, the drawing machine permits the child to produce creative patterns and pictures upon a drawing surface. The machine assists in the actual reproduction of a given shape by providing a traceable template and permits controlled positioning of the shape to be traced in order to achieve varying and creative patterns and pictures virtually anywhere on the plane of the drawing surface.

The drawing machine of the illustrated embodiment, generally designated 10, is adapted to be positioned upon a drawing surface generally designated 12, such as a sheet of paper or the like. The machine 10 includes a frame 14 adapted for translatory movement on the drawing surface. A plurality of template means or segments 16 are removably received upon the frame 14. Each template defines an aperture 18 of a given shape, which may be traced by the user with a pencil, pen, crayon or the like. The machine may be particularly suited for use with Crayola crayons (Crayola is a registered trademark of Binney & Smith, Inc.).

Frame 14 as illustrated is generally rectangular in shape. The frame, however, may be formed with any desirable peripheral outline which would include other geometric shapes or the shape of a figure, character, or object. The frame may be formed of any suitable material such as molded plastic, metal or the like. A top surface 20 includes an elongated recess or groove 22, which serves as a convenient retainer for drawing utensils.

The frame 14 defines an elongated interior opening 24, which extends transversely of the frame, and, as illustrated, is generally rectangular and of a length approximately three times its width. The opening 24 is defined by a recessed ledge 26 depressed slightly from the top surface 20 which defines spaced parallel guide surfaces 27.

The elongated interior opening 24 need not be rectangular. For example, it could be arcuate with guide surfaces 27 formed on concentric radii. However, to permit the desired controlled positioning of the template means, as will be explained, the elongated opening 24 should be elongated in a direction generally transverse to the axis upon which the frame 14 may be translated.

Underside 28 of frame 14, best seen in FIGS. 2 and 3, is arranged to support the drawing machine 10 upon the drawing surface 12 and permit translatory movement thereupon. A plurality of depending supports 30 extend downwardly of the frame 14 adjacent one longitudinal edge 32 of the frame 14. Each support 30 is provided with a rounded end 33 which contacts the drawing surface.

At opposite longitudinal edges 34, frame 14 is formed to define an enlarged housing portion 36 of generally semi-circular cross section. A plurality of depending axle supports 38 are provided interiorly of housing portion 36, which rotatably support an elongated axle 40 having spaced wheels or rollers 42. The wheels are fixed to the axle to rotate only in unison. This provides for the desired translational movement and prevents pivotal movement of the frame relative to one or the other of the wheels.

Cover 44 is secured to the underside 28 of frame 14 in overlying relation to the axle 40. It includes apertures 46 which expose the bottom portions of the wheels or rollers 42. The cover may be secured to the frame by any suitable means such as gluing, or sonic or thermal welding. When so secured the cover retains the axle within the depending axle supports 38 to permit free rotation of the axle and attached wheels or rollers 42.

As best seen in FIG. 2, axle supports 38, axle 40 and wheels 42 are sized to be compatible with the length of depending supports 30. The wheels 42 and depending supports 30 support the frame above the drawing surface and generally parallel thereto. The axle 40 with connected wheels 42 permits for translatory movement of the frame 10 upon the the drawing surface 12 in a direction generally perpendicular to the longitudinal extent of interior opening 24.

As illustrated, in FIG. 4, each template means 16 is substantially square. Of course the template means may be formed in any suitable peripheral shape so long as the shape permits guided movement of the template means 16 longitudinally of the interior opening 24, generally transversely to the axis of translatory movement of the frame 14.

Each template means includes a shoulder 48 extending around the outer periphery, and a recessed interior area 50. Each recess interior area defines an aperture 18. As shown in FIG. 1, the drawing machine of the embodiment illustrated includes three template means 16, defining apertures in the shapes of a square, triangle, and circle. Numerous variations are, of course, possible without departing from the inventive concept of the present invention. It is contemplated that the aperture 18 could be in the shape of the outline of a cartoon character, a human figure, an animal, or an inanimate object, as well as numerous other variations.

As shown in FIG. 2, a portion of the shoulder 48 of each template means 16 rests upon the recessed ledge 26 of the frame 14. The recessed interior area 50 of each template means 16 extends into the interior opening 24 of the frame 14 such that each drawing aperture 18 is disposed in closely spaced overlying relation to the drawing surface 12 within the boundary of said interior opening 24.

The template means are removably retained in the interior opening 24. The shoulder 48 of each template contacts the recessed ledge 26, which thereby maintains general alignment of the template within the opening 24. As shown, the shoulder 48 of each template includes a rough upper surface 52 to assist the user in holding the position of the template during use.

As shown in FIG. 2, the wheels 42 and depending supports 30 support the drawing machine 10 on the drawing surface 12. Translatory movement of the drawing machine 10 may be easily accomplished in a direction generally perpendicular to the longitudinal extent of the elongated interior opening 24. To roll the drawing machine, it is only necessary to slightly raise the supports 30. With a light push, the axle 40 and connected wheels 42 will rotate, and the rounded ends of the supports 30 will slide across the drawing surface. The fixed relation of the wheels to the axle assures that this movement is linear.

In addition to translatory mobility of the frame 14 with respect to the drawing surface 12, the template may be moved transversely of the frame 14, within the opening 24. For example, two template means may be removed, and the third slid laterally to any number of positions along opening 24. This movement is also linear in that the guide surfaces 27 of the frame restrict the movement of the shoulder 48 upon the recessed ledge 26.

One or more of the template means may be removed from opening 24 to permit translation of the remaining template longitudinally of opening 24. Also, each template may be removed and rotated relative to the frame 14 and reinserted. For example, the square template illustrated may be rotated 90°, 180°, or 270° and replaced upon the ledge 26.

Drawing of a pattern or picture is accomplished by tracing the outline of the aperture 18 of one or more of the template means upon the drawing surface 12. This can be accomplished using pencil, pen, crayon, or the like. The frame is first positioned in its desired position. The template used is then slid laterally of the opening 24 and positioned in its desired position. The user then presses firmly downwardly upon rough surface 52 of shoulder 48 to hold the template means in position while the aperture 18 is traced upon surface 12. Thereafter, the machine frame 14 may be translated along surface 12 or the template means 16 translated or repositioned in opening 24 and the tracing step repeated. Alternatively, one of the template means may be replaced with a different template means and a different shape traced upon the surface 12.

As can be appreciated, any number of creative and varied permutations and combinations of shapes may be thus created by the user. At the same time, the user, usually a child, will learn about such shapes, improve motor skills, and enhance creative capabilities.

Additional modifications and/or additions may be included by those skilled in the art without departing from the scope of the invention as defined by the claims.

We claim:

1. A drawing machine including a frame defining an elongated interior opening having a predetermined longitudinal extend;

said frame adapted for translatory movement upon a drawing surface generally transversely of the longitudinal extent of said opening;

said frame includes at least one depending support adapted to support said freame upon a drawing surface, and at least two rollers spaced from said at least one support adapted to support said frame upon the drawing surface and permit translatory movement thereof upon the drawing surface;

said frame defines a recessed ledge about said elongated opening; and at least one template means removably positionable upon said frame and overlying said opening;

said template means is of a length less than the longitudinal extent of said elongated interior opening such that said template means may be moved to various positions along the longitudinal extent thereof;

said template means defining a shaped aperture disposed within said opening in said frame and adapted to overlie a drawing surface in closely spaced relation thereto;

said template means include a peripheral shoulder removably disposed upon said ledge of said frame;

at least two template means are provided, each removably received on said frame and each defining a different aperture, each of said template means having a recessed interior area extending into said interior opening in said frame when said shoulder thereof is disposed upon said ledge, said recessed interior of each said template means defining said aperture thereof, and three template means are provided, one having an aperture defining a square, one having an aperture means defining a circle, and one having an aperture defining a triangle.

2. A drawing machine including a frame defining an elongated interior opening having a predetermined longitudinal extent;

said frame adapted for translatory movement upon a drawing surface generally transversely of the longitudinal extent of said opening;

said frame includes at least one depending support adapted to support said frame upon a drawing surface, and at least two rollers spaced from said at least one support adapted to support said frame upon the drawing surface and permit translatory movement thereof upon the drawing surface;

said frame defines a recessed ledge about said elongated opening; and at least one template means removably positionable upon said frame and overlying said opening;

said template means is of a length less than the longitudinal extent of said elongated interior opening such that said template means may be moved to various positions along the longitudinal extent thereof;

said template means defining a shaped aperture disposed within said opening in said frame and adapted to overlie a drawing surface in closely spaced relation thereto;

said template means include a peripheral shoulder removably disposed upon said ledge of said frame;

at least two template means are provided, each removably received on said frame and each defining a different aperture, each of said template means having a recessed interior area extending into said interior opening in said frame when said shoulder thereof is disposed upon said ledge, said recesed interior of each said template means defining said aperture thereof.

* * * * *